US005308130A

United States Patent [19]

Lee

[11] Patent Number: 5,308,130

[45] Date of Patent: May 3, 1994

[54] VEHICLE DOOR LATCH

[75] Inventor: Charles H. Lee, Almont, Mich.

[73] Assignee: General Motors Corporation, Detroit, Mich.

[21] Appl. No.: 992,663

[22] Filed: Dec. 18, 1992

[51] Int. Cl.[5] ..... E05B 3/00

[52] U.S. Cl. ..... 292/336.3; 292/229; 292/DIG. 22; 292/DIG. 65

[58] Field of Search ..... 292/336.3, DIG. 22, 292/DIG. 23, DIG. 26, DIG. 65, 229, 216

[56] References Cited

U.S. PATENT DOCUMENTS

| | | | |
|---|---|---|---|
| 3,400,962 | 9/1968 | Martens | 292/336.3 X |
| 3,799,596 | 3/1974 | Nozoma et al. | 292/DIG. 22 X |
| 4,536,021 | 8/1985 | Mochida | 292/DIG. 22 X |
| 4,552,399 | 11/1985 | Atarashi | 292/DIG. 22 X |
| 4,585,261 | 4/1986 | Adams et al. | 292/216 |
| 4,603,877 | 8/1986 | Espinoza et al. | 280/807 |
| 5,090,751 | 2/1992 | Kobayashi | 292/DIG. 22 X |

FOREIGN PATENT DOCUMENTS

| | | | |
|---|---|---|---|
| 2841546 | 4/1980 | Fed. Rep. of Germany | 292/DIG. 22 |
| 2228384 | 11/1974 | France | 292/DIG. 22 |

*Primary Examiner*—Rodney M. Lindsey
*Attorney, Agent, or Firm*—Charles E. Leahy

[57] ABSTRACT

A sliding side door of a van type automotive vehicle has a door latch mounted in the back end of the sliding door. The door latch includes a pivoted operating lever that is rotated to unlatch the door. The operating lever is connected to a pivoted transfer lever by a vertical rod. The transfer lever in turn is connected to a long horizontal rod that is pulled forward by an outside handle near the front of the sliding door to rotate the operating lever and unlatch the door. The pivoted operating lever is also engaged by a pivoted release lever that is connected to another long horizontal rod that is pulled forward by an inside door handle that is also near the front of the sliding door to rotate the operating lever and unlatch the door. The door latch is equipped with a block out mechanism that prevents rotation of the pivoted operating lever when the vehicle decelerates rapidly.

13 Claims, 3 Drawing Sheets

VEHICLE DOOR LATCH

BACKGROUND OF THE INVENTION

This invention relates generally to vehicle door latches and more particularly to vehicle door latches that can be installed in the back end of a vehicle side door that slides to an open position.

SUMMARY OF THE INVENTION

Van type automotive vehicles typically have a side door that slides out and back to an open position to provide access to the rear passenger and/or cargo compartment of the vehicle. These sliding side doors are typically safely and reliably latched in the closed position by a door latch that is mounted in the back end of the door and that engages a striker that is mounted on the door frame when the door is closed.

The door latch is typically unlatched by inside and outside door handles that are located at the front of the door and that are operatively connected to the door latch by long horizontal pull rods that are located within the frame of the door.

The object of this invention is to provide a door latch that has a block out mechanism that prevents any hypothetical movement of the operating lever of the door latch when a predetermined deceleration is reached.

A feature of the invention is that the block out mechanism is simple, compact and rugged.

Another feature of the invention is that the block out mechanism attaches directly to the door latch so that little, if any extra space is needed.

Another feature of the invention is that the block out mechanism blocks the operating lever of the door latch directly so that there are not any links between the block out mechanism and the latch bolt that have any possibility of movement.

Another feature of the invention is that the block out mechanism is economical to manufacture because most of the mechanism can be made of molded plastic.

Still another feature of the invention is that the block out mechanism uses a metal pin for a weight that can be changed to a different size easily to adjust the actuation of the block out mechanism for different installations.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
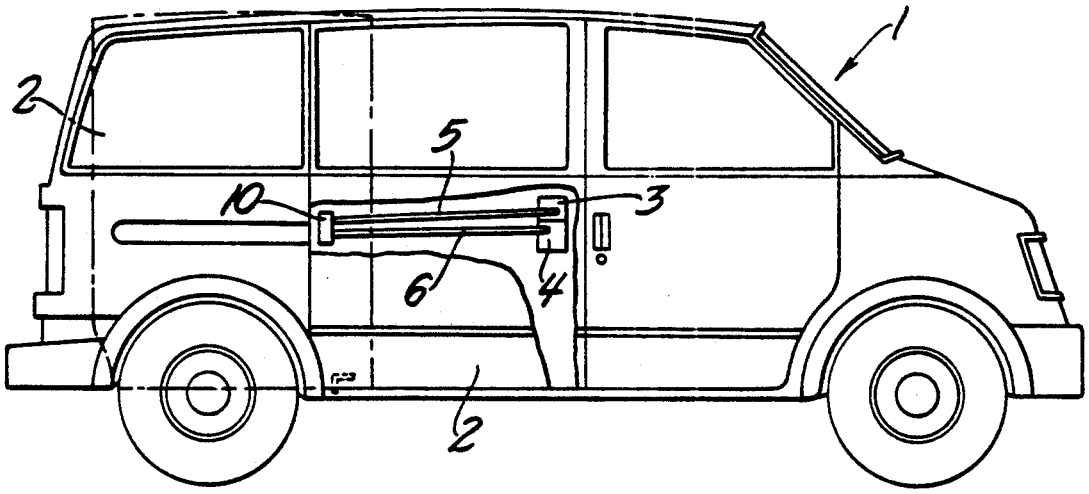
FIG. 1 is a side view of a van type automotive vehicle that has a door latch according to the invention mounted in the back end of a sliding side door.

Referring now to the drawing, FIG. 1 shows a van type automotive vehicle 1 that has a sliding type side door 2 that slides out and back from a closed position shown in solid lines to an open position shown in phantom lines. The sliding door 2 is latched in the closed position by a door latch 10 that is mounted in the back of the sliding door 2 so as to engage a striker (not shown) that is mounted on the door frame when the sliding door 2 is in the closed position as shown in FIG. 1. The door latch 10 is unlatched by inside and outside door handles 3 and 4 that are located at the front of the sliding door 2. The inside door handle 3 is operatively connected to the door latch 10 by a long rod 5 that is longitudinally disposed inside the frame of the sliding door 2. The rod 5 unlatches the door latch 10 when it is pulled forward, that is, toward the right as viewed in FIG. 1, by operation of the inside door handle 3. The outside door handle 4 is operatively connected to the door latch 10 by another long rod 6 that is also longitudinally disposed inside the door frame. Rod 6 also unlatches the door latch 10 when it is pulled forward by operation of the outside door handle 4.

The door latch 10 is shown in detail in FIGS. 2 through 8. The basic part of the door latch 10 is substantially the same as a door latch that has been widely used in present and previous production vehicles manufactured by General Motors Corporation. The details of the basic part of the door latch 10 are well known in view of this widespread use. Moreover the basic part of the door latch 10 is described in U.S. Pat. No. 4,585,261 granted to Frederic R. Adams et al Apr. 29, 1986 for a Vehicle Closure Latch And U.S. Pat. No. 4,603,877 granted to John A. Espinoza et al Aug. 5, 1986 for Control Means for Occupant Restraint System, both of which are hereby incorporated by reference. Therefore a brief description of the basic operating components is sufficient.

Briefly the latch 10 includes a frame 12 having an integral side wall or flange 14, with the frame and side wall being apertured at 16 to provide for entrance and exit of a striker, not shown. The striker is mounted on the door frame in proximity to the latch 10. A plastic coated fork type bolt 18 is pivoted at 20 to the frame 12. The bolt is shown in the released or unlatched position. A detent 22 is pivoted at 24, FIGS. 3 and 5 to the frame 12 and includes a foot or shoulder 26 which is engageable with either a shoulder 28, or a shoulder 30 of the bolt 18 to hold the bolt respectively in either intermediate latched or fully latched position. A tension spring 32 is hooked between a leg 34 of the detent 22 and the flange 14 of the frame to continually bias the detent 22 clockwise as viewed in FIGS. 1 and 4 towards engaged position with the bolt 18. The detent 22 is located against the bias of spring 32 by the engagement of a leg 36 thereof with a rubber bumper 38 secured to a lanced lateral tab of frame 12.

Figure 3:
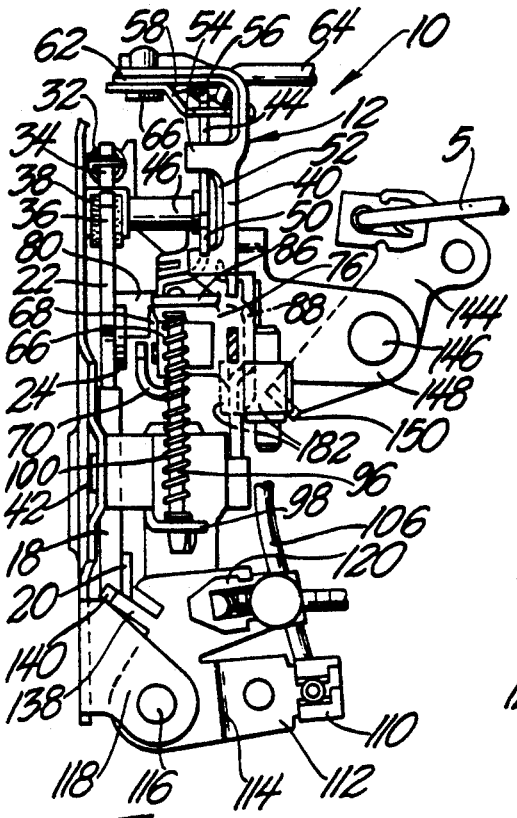
FIG. 3 is a side view of the door latch taken substantially along the line 3—3 of FIG. 2 looking in the direction of the arrows.

A back plate 40 is spaced from the frame 12 and includes lateral tabs 42 which are staked to the frame 12 to secure the back plate. A locking lever 44 is pivoted to a pin 46 extending between frame 12 and the back plate 40. An overcenter spring 48 is hooked between the locking lever 44 and the back plate 40 to selectively and alternately bias the locking lever to unlocked position, as shown, or to a locked position clockwise of this position. The locking lever 44 is alternately located in each position by respective engagement of a leg 50 thereof with the lower and upper edges of a U-shaped slot 52, FIG. 3 provided in a lateral tab 54 of the back plate 40. Another leg 56 of locking lever extends upwardly and is trapped in a slot of an auxiliary lever 58 which is pivoted at 60 to a rib reinforced flange 62 of the back plate. The lever 58 is connected by a rod 64 to a conventional outside key cylinder to move the locking lever between locked and unlocked positions.

Figure 5:
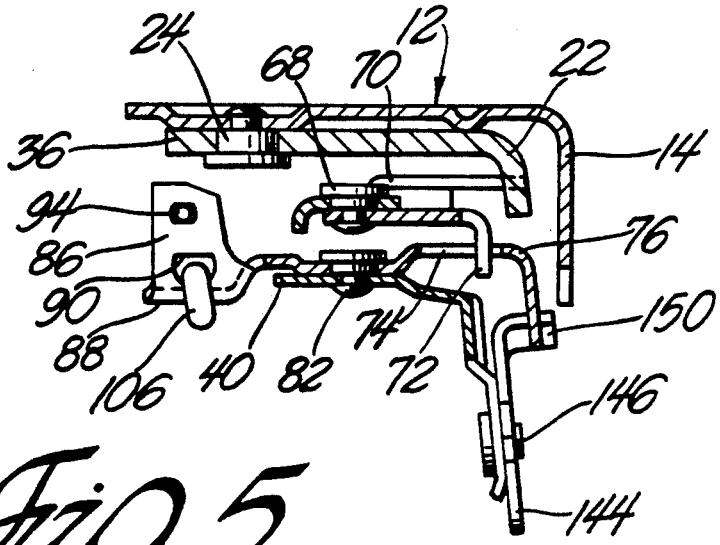
FIG. 5 is a section taken substantially along the line 5-5 of FIG. 2 looking in the direction of the arrows.

An offset leg 66 of the locking lever 44 is pivoted at 68, FIGS. 3 and 5 to one leg of a U-shaped intermittent member 70. This leg includes a lateral tab 72 which extends through an arcuate slot 74 of an operating lever 76 for a purpose to be described. The other leg 78 of the intermittent member extends toward flange 14 and is movable into and out of abutting relationship to the lower edge of a lateral tab 80 of the detent 22. The operating lever 76 is pivoted at 82 to the back plate 40. The pivot 82 is coaxial with the pivot 68, FIG. 5.

When the locking lever 44 is in its unlocked position, as shown, the leg 78 of the intermittent member 70 is in abutting relationship to the lower edge of the tab 80 of the detent 22. The intermittent member rotates the detent counterclockwise about its pivot 24 when the intermittent member is rotated counterclockwise about its pivot 68 by the operating lever 76. Should the bolt 18 be in either latched position with the foot 26 of the detent in engagement with either shoulder 28 or 30 of the bolt, counterclockwise rotation of the detent 22 will release the detent foot from the engaged bolt shoulder 28 or 30 to permit the door to be opened as the striker rotates the bolt to its unlatched position, as shown. The foot 26 of the detent 22 rests on the edge 84 of the leading leg of bolt 18. When the door is closed, the engagement of the striker pin with this leading leg rotates the bolt to latched position wherein the striker pin is trapped in the bolt throat and the detent foot 26 engages either shoulder 28 or shoulder 30.

Figure 4:
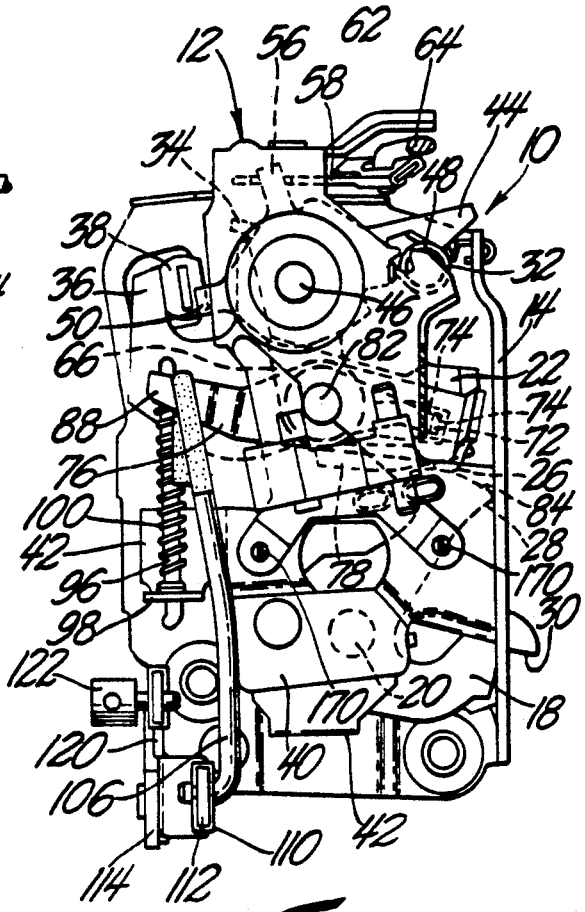
FIG. 4 is a front view of the door latch that is shown in FIG. 2.
Figure 6:
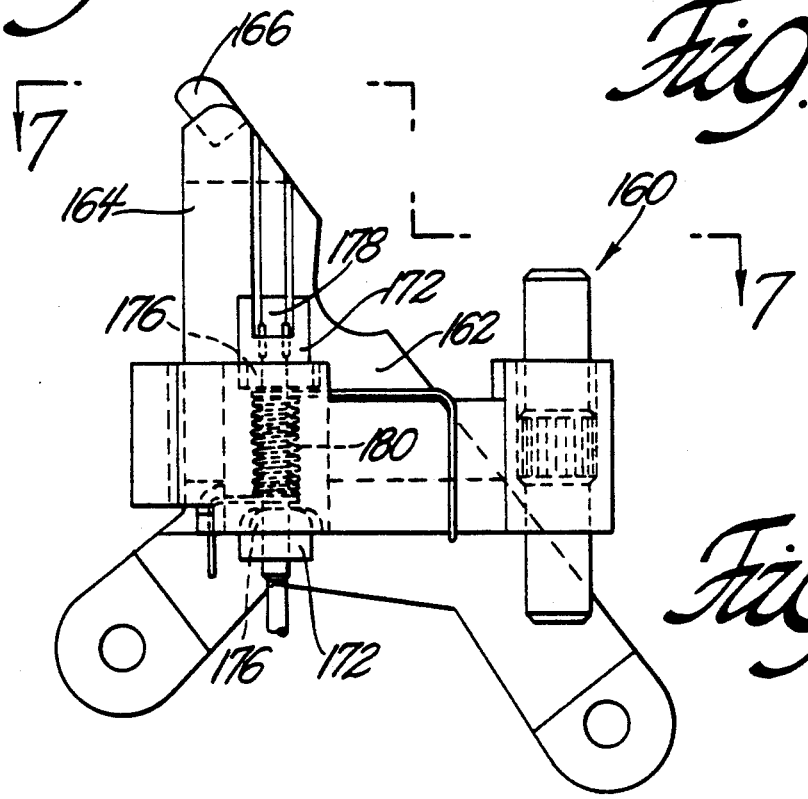
FIG. 6 is an enlarged front view of a portion of FIG. 4 showing the block out mechanism.
Figure 7:
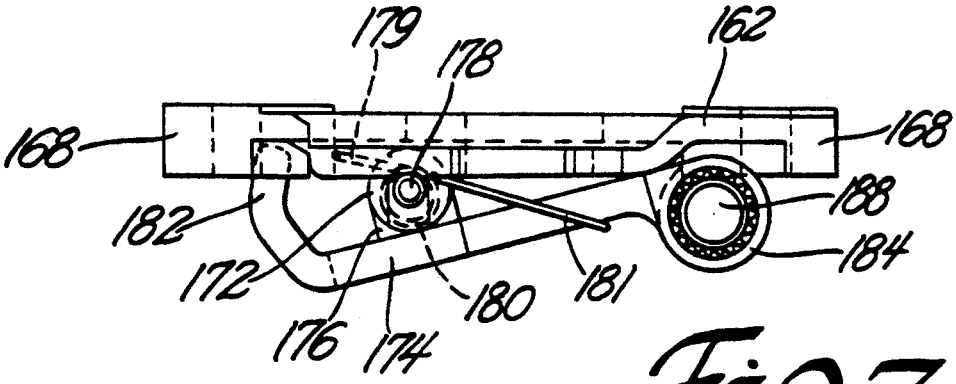
FIG. 7 is top view of the block out mechanism taken substantially along the line 7—7 of FIG. 6 looking in the direction of the arrows.
Figure 8:
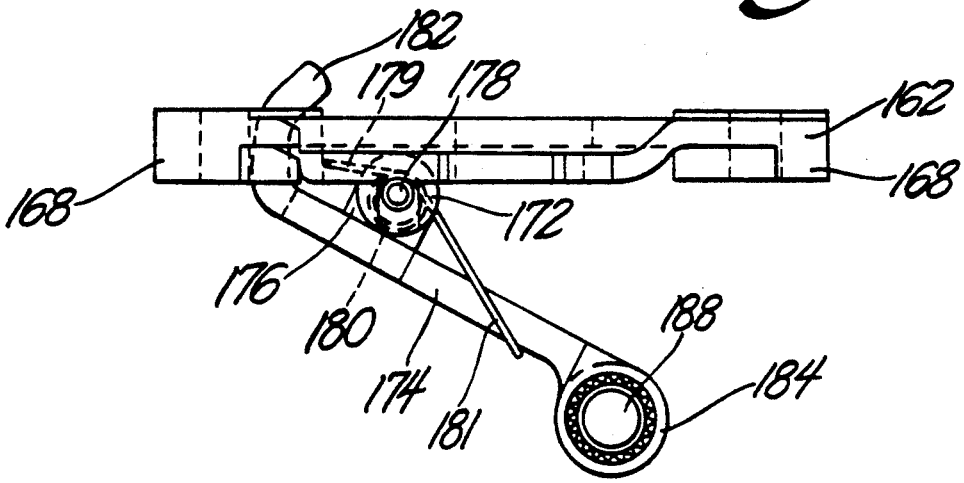
FIG. 8 is a top view of the block out mechanism showing the parts in the lock out position.

Should the locking lever 44 be in its locked position, clockwise of its position shown, the leg 78 of the intermittent member 70 will move to the left, FIGS. 4 and 5 and out of abutting relationship to the lower edge of the tab 80 so that rotation of the operating lever 76 will not have any effect on the detent 22.

The foregoing is a brief description of the manner in which the basic structure of the lock operates. The latching and lock out features will now be described.

As shown in FIGS. 2 through 5 the lefthand end of the operating lever 76 includes a pair of legs 86 and 88 which are angularly related to each other, preferably normal to each other. A closed end slot 90 traverses both legs and the juncture therebetween, with the closed end of the slot in the leg 88 being arcuate to provide a bearing surface or area. The leg 86 includes an opening 94 which slidably receives the upper end of a pin 96, the lower shouldered end of which is staked to a tab 98 of back plate 40. A coil spring 100 surrounds the pin 96 and seats between the shouldered end of the pin and the lower surface of leg 86 to continually bias the lever 76 clockwise about its pivot 82.

The U-shaped or hooked upper end 104 of a transfer rod 106 has the bight thereof rotatably seating on the bearing area of slot 90. The rod 106 can be assembled to the lever by inserting the shorter leg of the rod through the slot 90. The lower end of the rod 106 is bent laterally and secured by a conventional spring clip 110 to one offset leg 112 of a bell crank transfer lever 114. The lever 114 is pivoted at 116 to an integral lateral ear or arm 118 of the frame 12. The other leg 120 of the transfer lever 114 rotatably mounts a stud 122 which threadedly receives the lower threaded end of rod 6. Rod 6, as shown in FIG. 1 extends longitudinally to the front of the door 2 where it is operatively connected to a conventional outside door handle 4.

As best shown in FIG. 3, the lever 114 includes an integral narrow bendable tab 138 having a terminal lateral flange 140 which is engageable with an edge of the ear 118 to locate the lever 114 in a counterclockwise direction relative to the ear.

After the transfer rod 106 is assembled between the operating lever 76 and the transfer lever 114, the tab 138 is bent relative to the lever 114 to locate the lever 114 about pivot 116 such that the resilient bias of spring 100 on operating lever 76 takes up any lost motion between the lever 76, rod 106 and transfer lever 114. This ensures that the lever 114 can be located relative to lever 76 by rod 106 in a rattle free position when the latch is assembled and that this position will remain throughout the life of the latch unless positively changed by bending tab 138. The end portion of the rod 106 can be coated with plastic to reduce the noise level.

Figure 2:
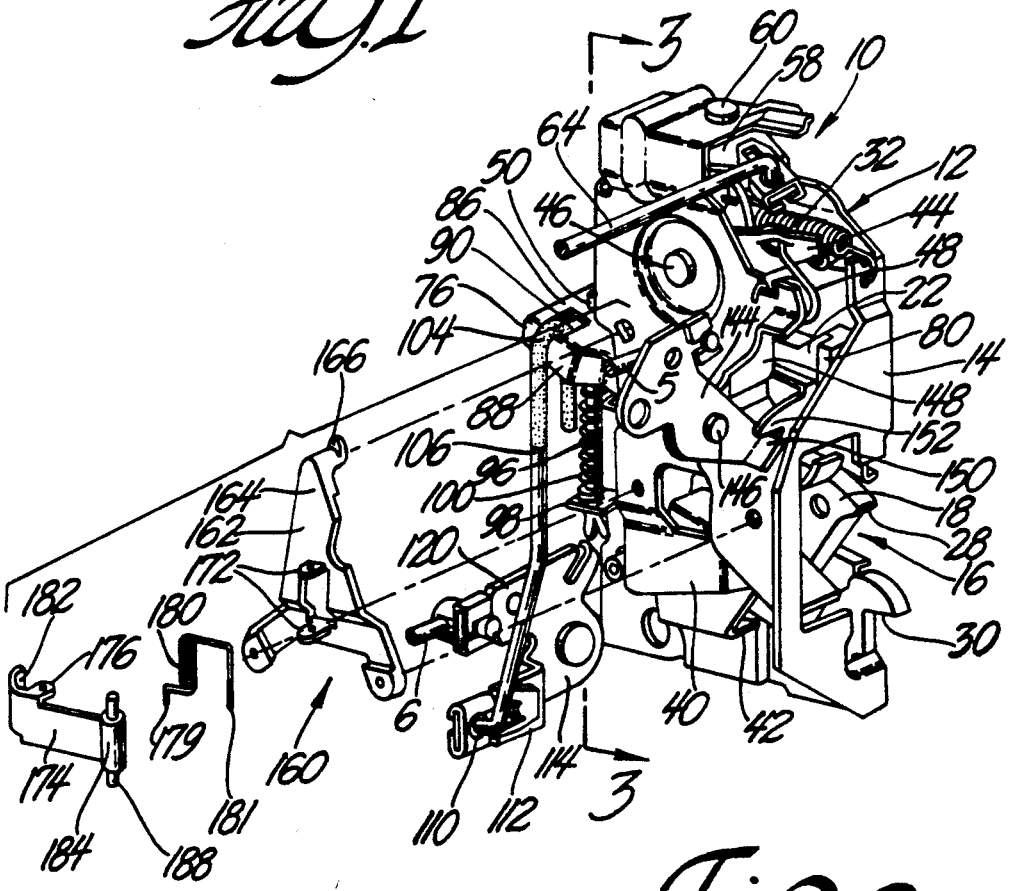
FIG. 2 is a partially exploded perspective view of the door latch that is shown schematically in FIG. 1.

When the lever 114 is rotated counterclockwise by the outside handle 4, the rod 106 shifts down vertically to rotate the operating lever 76 counterclockwise to release the lock bolt 18 as viewed in FIG. 2. (Lever 114 is rotated clockwise as viewed in FIG. 3.)

An inside release member, such as handle 3, is connected by a rod, FIGS. 1, 2 and 3, with an inside release lever 144 which is pivoted at 146 to an offset lateral flange or ear 148 of back plate 40. The lever 144 includes a lateral tab 150 which underlies a lateral tab 152 of the operating lever 76 so that rotation of the lever 144 in a counterclockwise direction as viewed in FIG. 2 (or clockwise as viewed in FIG. 3) operates to rotate operating lever 76 counterclockwise about its pivot 82.

It will be noted that rotation of operating lever 76 by the rod 6 occurs without rotation of the lever 144 and likewise rotation of the lever 76 by the lever 144 occurs without any movement of the rod 6.

The block out mechanism of this invention is generally indicated at 160. It comprises a support bracket 162 made of a suitable plastic material such as acetal. The support bracket 162 is three legged having one upper and two lower legs. The upper leg 164 has an offset tab 166 at the end that is snaked through a hole in the back plate 40 to fasten the upper leg 164 to the frame 12. Each of the lower legs 168 has a hole for sheet metal screws 170 that fasten the two lower legs to the back plate 40 as shown in FIG. 4. The support bracket 162 includes two vertically spaced tabs 172 for pivotally supporting a block out lever 174 on a generally vertical axis.

The lever 174 has a pair of vertically spaced tabs 176 that fit between the vertically spaced tabs 172 of the support bracket 162. The tabs 172 and 176 have aligned apertures that receive a pivot pin 178 so that the block out lever 174 pivots on the support bracket 162. The pivot pin 178 includes darts that embed in the upper tab 172 to secure the pivot pin 178 to the support bracket 162.

The block out mechanism 160 also includes a coil return spring 180 that is disposed around the pivot pin 178 between the tabs 176. The return spring 180 has a tab 179 at one end that engages the face of the support bracket 162 and a tab 181 at the other end that hooks over the lever 174 so that the block out lever 174 is biased in the counter clockwise direction as viewed in FIGS. 7 and 8. The return spring 180 holds the block out lever 174 in an unactuated position shown in FIG. 7 when the vehicle 1 is at rest or travelling at constant velocity. In this position, the block out lever 174 is out of the path of movement of the operating lever 76 as best shown in FIG. 3. Consequently the operating lever 76 is free to pivot counterclockwise from the position shown in FIGS. 2 and 4 to unlatch the door latch 10.

The block out lever 174 has a stop in the form of a flange 182 at one end and a sleeve 184 at the other end. The lever 174 includes a solid cylindrical pin 188 that has a splined mid section that is force fit in the sleeve 184 at the end of the block out lever 174. The pin 188 is of a substantially greater mass than the rest of the block out lever 174 so that it acts as a weight that pivots the lever 174 clockwise against the bias of return spring 180 in response to vehicle deceleration. When the vehicle deceleration exceeds a predetermined value, the undecelerated weight of the pin 188 overcomes the bias of return spring 180 and pivots the lever 174 clockwise to an actuated position shown in FIG. 8. In this position the flange 182 is positioned under the operating lever 76. This blocks the operating lever 76 so that it cannot pivot counterclockwise from its latched position shown in FIGS. 2 through 5 to unlatch the door latch 10. The weight of the pin 188 is selected so that the weight of the pin 188 pivots the block out lever 174 to the actuated position shown in FIG. 8 before the weight of rods 5 and 6 and the latch releasing parts associated therewith rotate the operating lever 76 any appreciable amount. In other words, the block out mechanism 160 is actuated at a "G" force that is below that which causes the rods 5 and 6 move any appreciable amount so as to prevent the block out lever 174 from being pivoted into the actuated position shown in figure 8. Consequently the block out mechanism 160 very effectively counteracts the forces that are produced by the long latch releasing rods 5 and 6 and associated releasing parts during vehicle deceleration.

Moreover it is to be noted that the block out mechanism 160 is an economical, rugged, compact simple design that attaches directly to the door latch 10 easily. Furthermore actuation can be adjusted for different applications simply by changing pin 188 to a lighter or heavier pin as needed.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A block out mechanism for an automotive vehicle door latch that includes a movably mounted operating lever that is moved by release means comprising;

a block out lever that is pivotally mounted on the door to pivot about a generally vertical axis between an unactuated position and an actuated position, means biasing the block out lever toward the unactuated position, the block out lever having a stop and a weight so that the block out lever pivots toward the actuated position in response to deceleration of the vehicle, the stop being out of the path of movement of the operating lever when the block out lever is in the unactuated position, the stop being in the path of movement of the operating lever to prevent unlatching of the door latch when the block out lever is in the actuated position, and the weight being sufficient to pivot the block out lever to the actuated position before the release means rotate the operating lever any appreciable amount in response to vehicle deceleration.

2. The block out mechanism as defined in claim 1 wherein the weight is a pin and the pin is changeable so that actuation of the block out mechanism can be adjusted for different applications of the door latch easily.

3. The block out mechanism as defined in claim 1 wherein the block out lever is mounted by a support and wherein the support is three-legged and each leg has means for attaching the support to a metal back plate of a door latch.

4. The block out mechanism as defined in claim 1 wherein the block out lever is pivotally mounted on a support by a pivot pin and the biasing means is a coil spring that surrounds the pivot pin.

5. The block out mechanism as defined in claim 1 wherein the block out lever is mounted by a support and wherein the support is three-legged and each leg has means for attaching the support to a metal back plate of a door latch, the block out lever is pivotally mounted on the support by a pivot pin, the biasing means is a coil spring that surrounds the pivot pin, and the weight is a pin and the pin is changeable so that actuation of the block out mechanism can be adjusted for different applications of the door latch easily.

6. A block out mechanism for an automotive vehicle door latch that includes a pivotally mounted operating lever that is rotated about a longitudinal axis by release means and that include levers that rotate about transverse axes to engage and rotate the operating lever, comprising;

a support that is adapted to be secured to a frame of the door latch in a position near the pivotally mounted operating lever, a block out lever that is pivotally mounted on the support to pivot about a generally vertical axis between an unactuated position and an actuated position, spring means biasing the block out lever toward the unactuated position, the block out lever having a stop at one end and a sleeve at the other end that carries a pin of substantial weight so that the block out lever pivots toward the actuated position in response to deceleration of the vehicle, the stop being out of the path of movement of the operating lever when the block out lever is in the unactuated position, the stop being in the path of movement of the operating lever to prevent unlatching of the door latch when the block out lever is in the actuated position, and the weight of the pin being sufficient to pivot the block out lever to the actuated position before the release means rotates the operating lever any appreciable amount in response to vehicle deceleration.

7. The block out mechanism as defined in claim 6 wherein the pin is changeable so that actuation of the block out mechanism can be adjusted for different applications of the door latch easily.

8. The block out mechanism as defined in claim 6 wherein the support is three-legged and each leg has means for attaching the support to a metal back plate of a door latch.

9. The block out mechanism as defined in claim 6 wherein the block out lever is pivotally mounted on the support by a pivot pin and the spring means is a coil spring that surrounds the pivot pin.

10. The block out mechanism as defined in claim 6 wherein the support is three-legged and each leg has means for attaching the support to a metal back plate of a door latch, the block out lever is pivotally mounted on the support by a pivot pin, the spring means is a coil spring that surrounds the pivot pin, and the pin is changeable so that actuation of the block out mechanism can be adjusted for different applications of the door latch easily.

11. An automotive vehicle door latch comprising:

a pivotally mounted operating lever that is rotatable about a longitudinal axis, release means for rotating the operating lever to an unlatched position that includes at least one lever that rotates about a transverse axis, a block out lever that is pivotally mounted near the operating lever to pivot about a generally vertical axis between an unactuated position and an actuated position, spring means biasing the block out lever toward the unactuated position, the block out lever having a stop at one end and a weight at the other end so that the block out lever pivots toward the actuated position in response to deceleration in the longitudinal direction, the stop being out of the path of movement of the operating lever when the block out lever is in the unactuated position, the stop being in the path of movement of the operating lever to prevent unlatching of the door latch when the block out lever is in the actuated position, and the weight being selected to pivot the block out lever to the actuated position before the release means rotate the operating lever any appreciable amount in response to a predetermined deceleration.

12. The vehicle door latch as defined in claim 11 further including a support that is secured to a frame of the door latch in a position near the pivotally mounted operating lever and wherein the block out lever is pivotally mounted on the support to pivot about the generally vertical axis between the unactuated position and the actuated position.

13. The block out mechanism as defined in claim 12 wherein the support is three-legged and each leg has means for attaching the support to a metal back plate of a door latch, the block out lever is pivotally mounted on the support by a pivot pin, the spring means is a coil spring that surrounds the pivot pin and the pin is changeable so that actuation of the block out mechanism can be adjusted for different applications of the door latch easily.

* * * * *